US007737675B2

(12) United States Patent
Murase

(10) Patent No.: US 7,737,675 B2
(45) Date of Patent: Jun. 15, 2010

(54) REFERENCE CURRENT GENERATOR ADJUSTABLE BY A VARIABLE CURRENT SOURCE

(75) Inventor: Yuko Murase, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 336 days.

(21) Appl. No.: 11/898,262

(22) Filed: Sep. 11, 2007

(65) Prior Publication Data

US 2008/0067996 A1 Mar. 20, 2008

(30) Foreign Application Priority Data

Sep. 15, 2006 (JP) ..... 2006-250777

(51) Int. Cl.
*G05F 3/16* (2006.01)
*G05F 3/20* (2006.01)

(52) U.S. Cl. ..... 323/314; 323/313; 323/315; 323/316

(58) Field of Classification Search ..... None
See application file for complete search history.

(56) References Cited

U.S. PATENT DOCUMENTS

| | | | | |
|---|---|---|---|---|
| 5,646,518 | A | 7/1997 | Lakshmikumar et al. | |
| 5,789,906 | A * | 8/1998 | Mizuide | 323/313 |
| 6,031,365 | A * | 2/2000 | Sharpe-Geisler | 323/313 |
| 6,031,366 | A | 2/2000 | Mitsuishi | |
| 6,147,548 | A * | 11/2000 | Doyle | 327/539 |
| 6,150,872 | A | 11/2000 | McNeill et al. | |
| 6,501,256 | B1 * | 12/2002 | Jaussi et al. | 323/315 |
| 6,608,472 | B1 * | 8/2003 | Kutz et al. | 323/313 |
| 7,321,225 | B2 * | 1/2008 | Garlapati et al. | 323/313 |
| 2006/0164158 | A1 | 7/2006 | Kimura | |

FOREIGN PATENT DOCUMENTS

| | | |
|---|---|---|
| JP | 11065688 | 3/1999 |
| JP | 11-121694 | 4/1999 |
| JP | 2003-263232 A | 9/2003 |
| JP | 2006209212 A | 8/2006 |
| WO | 2006030375 A1 | 3/2006 |

OTHER PUBLICATIONS

Mishimagi; Japanese Office Action; 2006-250777; Oct. 7, 2008.
Japanese Office Action 'Notification of Reason for Refusal' dated Sep. 28, 2009; Patent Application No. 2006-250777; with extract English translation.

* cited by examiner

*Primary Examiner*—Bao Q Vu
(74) *Attorney, Agent, or Firm*—Studebaker & Brackett PC; Donald R. Studebaker

(57) ABSTRACT

A reference current generator for outputting a current proportional to absolute temperature includes a fixed current source transistor, a variable current source transistor and an output transistor which are connected to a drain voltage line. The fixed current source transistor is connected to a source voltage via a series of resistor and first diode. The variable current source transistor is connected to the source voltage via a second diode. A first node between the variable current source transistor and the resistor is connected with a noninverting input of an operational amplifier, and a second node between the variable current source transistor and the second diode is connected with an inverting input of the operational amplifier. The operational amplifier has its output connected to the gate electrode of both the fixed current source transistor and the output transistor, which outputs a PTAT current depending upon the gate voltage.

3 Claims, 8 Drawing Sheets

700
Vdd
Vss
12
14
T1
16
T2
(S×I1)
T3
18
T4
614
46
Iout
612
Vref
Vc
44
30
28
Va
32
Vb
602
604
606
R1
R2
608
610
402
R0
Re
20
22
D1
40
V1
404
R0
42
V2
26
D2
(D1 : D2 = K : 1)
24

REFERENCE CURRENT GENERATOR ADJUSTABLE BY A VARIABLE CURRENT SOURCE

BACKGROUND OF THE INVENTION

1. Field of the Invention

The present invention relates to a reference current generator in a semiconductor integrated circuit for generating a reference current such as a current substantially proportional to absolute temperature (PTAT).

2. Description of the Background Art

U.S. Pat. Nos. 5,646,518 to Lakshmikumar et al., and 6,150,872 to McNeill et al., disclose a PTAT current source that generates a reference current to be used in a semiconductor integrated circuit. The PTAT current source generates a current which increases substantially in proportion to absolute temperature, i.e. a PTAT current.

In such a current source, for example, a current varies due to the variability of device parameters caused by the manufacturing process of a semiconductor integrated circuit. To eliminate this problem, for instance, Japanese patent laid-open publication No. 121694/1999 teaches a reference voltage generator including adjusting means for adjusting the level of current in a current source after manufactured in the form of semiconductor integrated circuit. The adjusting means fine-tunes a reference current by utilizing, e.g. fuses and resistance elements, to change the values of resistance.

The conventional adjusting method, however, has a problem that the resistance of switches, when conductive, are incorporated into the resistances. Moreover, in order to improve the adjustment precision, a required number of resistance elements must be provided, which are interconnected to the respective switches having the resistance value thereof slightly different from each other. It leads to an increase in size of the circuitry.

SUMMARY OF THE INVENTION

It is an object of the present invention to provide a reference current generator for outputting a current substantially proportional to absolute temperature, in which a significant increase in a circuit size is prevented.

In accordance with the present invention, a reference current generator for generating a current substantially proportional to absolute temperature (PTAT) includes an operational amplifier for generating a PTAT current, an output circuit for outputting the current delivered from the operational amplifier and a variable current source connected to the output of the operational amplifier for varying the PTAT current.

Further in accordance with the present invention, a reference current generator for generating a current substantially proportional to absolute temperature includes a first transistor serving as a current source for generating a fixed current; a resistance element connected to the transistor, a first diode connected to the resistance element; a variable current source controlled by a variable current, a second diode connected to the variable current source; an operational amplifier having its first input terminal connected to a first node between the first transistor and the resistance element and its second input terminal connected to a second node between the variable current source and the second diode to thereby perform operational amplification of voltage at the first and second nodes; and a second transistor connected to an operational output of the operational amplifier to output a current depending on the operational output.

In one aspect of the present invention, the variable current source may include a plurality of transistor elements and a plurality of switches for selecting at least any one of the plurality of transistor elements. The output of the operational amplifier is also connected to the gate electrodes of the first and second transistors and the variable current source. The variable current source input the obtained operational output to the gate electrodes of the plurality of transistor elements to supply the second input terminal and the second diode with the current output of at least any one of the transistor elements selected by the plurality of switches as an output of the variable current source.

In accordance with the present invention, a significant increase in circuit size can be prevented, and a variable current can be adjusted by a variable current source supplying a variable current by which a current substantially proportional to absolute temperature can be output from the output circuit.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
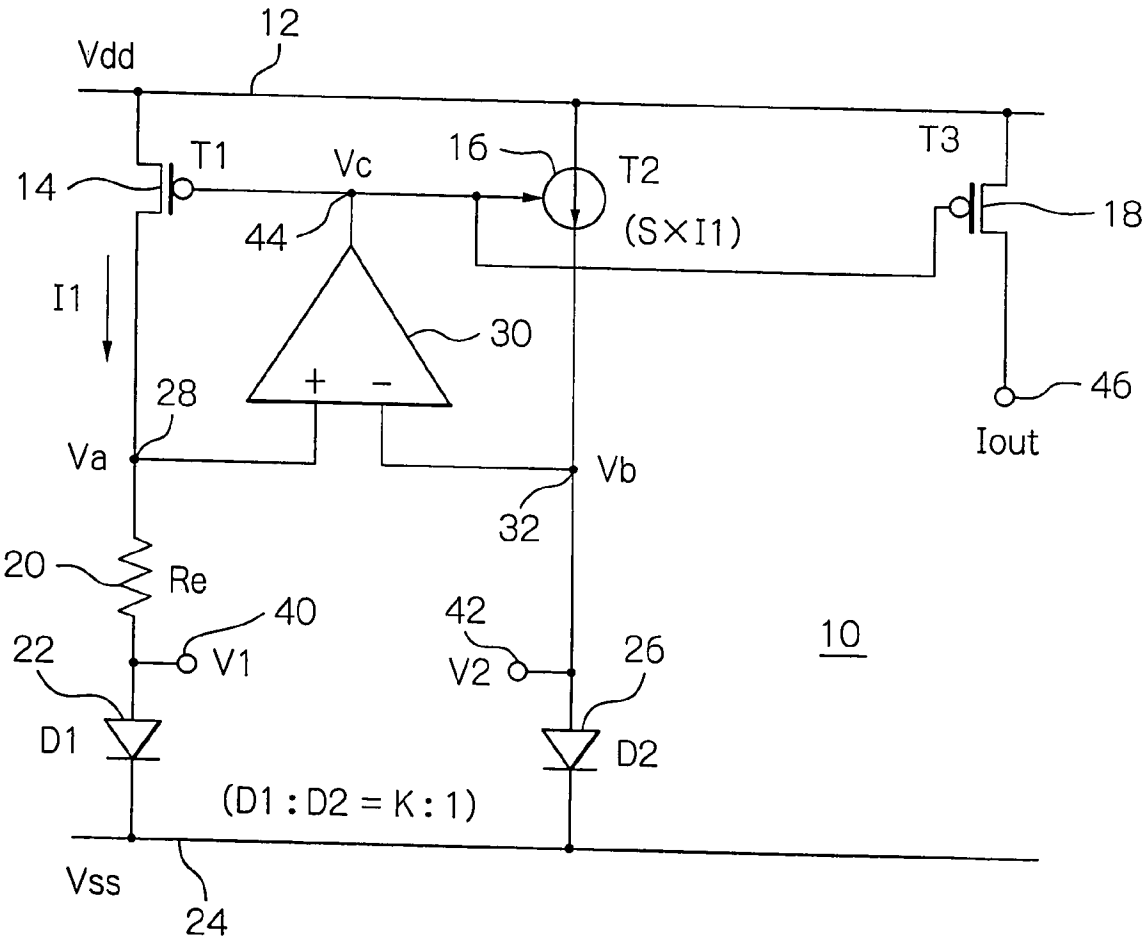
FIG. 1 is a schematic circuit diagram showing a preferred embodiment of a PTAT current generator in accordance with the present invention.

Preferred embodiments of a reference current generator of the present invention will now be described in detail with reference to the accompanying drawings. With reference first to FIG. 1, showing a preferred embodiment of the PTAT current generator in accordance with the present invention, a PTAT current generator 10 is a semiconductor integrated circuit for generating a current substantially proportional to absolute temperature (PTAT), that is, a PTAT current.

The PTAT current generator 10 includes a transistor (T1) 14 serving as a fixed current source, another transistor (T2) 16 serving as a variable current source, and still another or output transistor (T3) 18 connected to one power supply or drain voltage line (Vdd) 12. The transistor 14 is connected to another power supply or source voltage line (Vss) 24 via a series of a resistance element 20 having its resistance Re and a diode (D1) 22, while the transistor 16 is connected to the power supply line 24 via another diode (D2) 26. The diode 22 contains a plurality (K) of diodes, not shown, connected in parallel to each other, each of the diodes being the same as the diode 26, where K is a natural number.

Between the transistor 14 and the resistance element 20 is a node (Va) 28 connected to a noninverting input terminal (+) of an operational amplifier 30, and between the transistor 16 and the diode 26 is anode (Vb) 32 connected to an inverting input terminal (−) of the operational amplifier 30.

Provided to a node between the resistance element 20 and the diode 22 is a terminal 40, from which a voltage V1 is output. To a node between the transistor 16 and the diode 26, a terminal 42 is provided, from which a voltage V2 is output. Applied to the noninverting input terminal (+) of the operational amplifier 30 is a voltage Va, and to the inverting input terminal (−) is another voltage Vb.

The operational amplifier 30 also has its output 44 connected to the gate electrodes of the transistors 14 and 18 in common, and the latter transistor 18 is adapted to output a PTAT current (Iout) on its output 46 in response to a gate voltage applied to the gate electrode 44. The output 44 of the amplifier 30 is also connected to the transistor 16 to variably adjust the current passing through the transistor 16.

Figure 2:
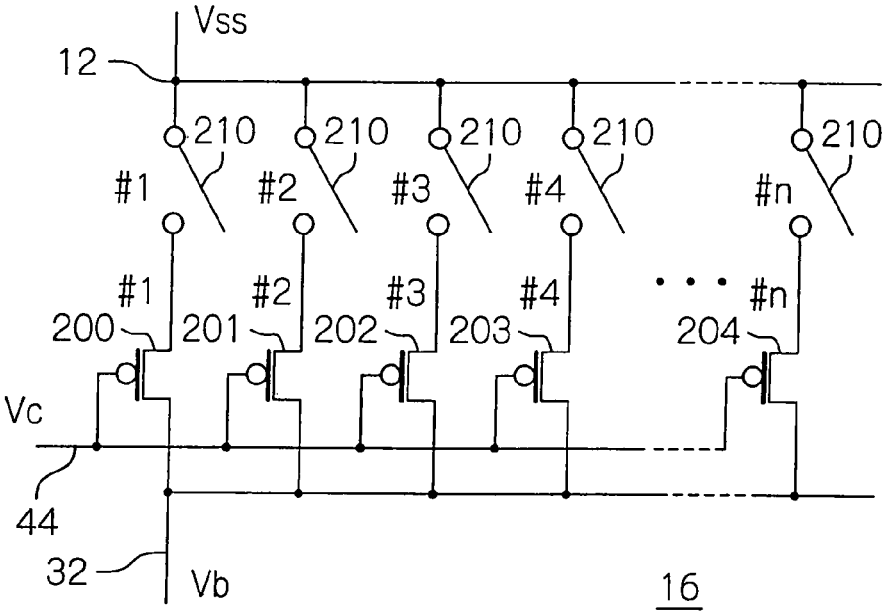
FIG. 2 schematically shows a configuration example of a transistor included in the embodiment shown in FIG. 1.

FIG. 2 shows a configuration example of the transistor 16. The transistor 16 serving as a variable current source has been described above as if it were generally comprised of a single transistor. Actually, however, it is constituted of a plurality (n) of transistors 200 through 204, which are selectable by means of a corresponding plurality (n) of switches 210, as will be described later more in detail, where n is a natural number more than one. More specifically, with respect to the node (Vb) 32 the transistors (#1 to #n) 200 to 204 are arranged in parallel to each other, each of which functions as a current source and is different in size. Furthermore, the transistors 200 to 204 are connected via the respective switches (#1 to #n) 210 with the power supply line (Vdd) 12. The transistors 200 to 204 have gate electrodes connected in common to the node (Vc) 44. In this way, the transistors 200 to 204, generally behaving as the single transistor (T2) 16, are connected to form a current mirror together with the transistor (T1) 14, FIG. 1.

In the following, the operation of the PTAT current generator 10 in the above configuration will be described. Now, if a current passing through the transistor (T1) 14 is represented by I1, then the current passing the transistor (T2) 16 can be represented by S×I1, where S is a non-dimensional value, i.e. current ratio. The current ratio S is dependant upon the length and the width of the gate electrode of the transistors 14 and 16.

When the operational amplifier 30, FIG. 1, is in operation, the nodes (Va) 28, (Vb) 32 and (Vc) 44 become at almost the same potential as each other. Consequently, the resistance value Re×the current I1+the voltage V1 is equal to the voltage V2. The voltages V1 and V2 can be expressed by a general formula of a junction type of diode. Specifically, the reference current Iout output from the output 46 can be represented by the following expression:

$$Iout=Vt\times LN(K\times S)/Re \quad (1)$$

where Vt means the threshold voltage of the diodes, LN represents natural logarithm and K is a size ratio of the diode (D1) 22 to the diode (D2) 26.

It is assumed here that the transistor (T1) 14 and the transistor (T3) 18 are identical to each other, and the current Iout equals I1. Assume that the ratio (W3/L3) of the width to the length of the gate electrode of the transistor 18 is equal to N×the ratio (W1/L1) of the width to the length of the gate electrode of the transistor 14, then the output reference current Iout is equal to N×I1.

As is clear from the expression (1), the adjustment to the current passing through the diode (D2) 26 by turning on any of the switches 210 in the current source 16 is effective in substantially adjusting the ratio K of the diodes (D1) 22 to (D2) 26.

If the output current Iout when S is equal to one is represented by Iout0, the expression (1) can be changed to the following expression:

$$Iout/Iout0=1+\mathrm{Log}_K S \quad (2)$$

Figure 3:
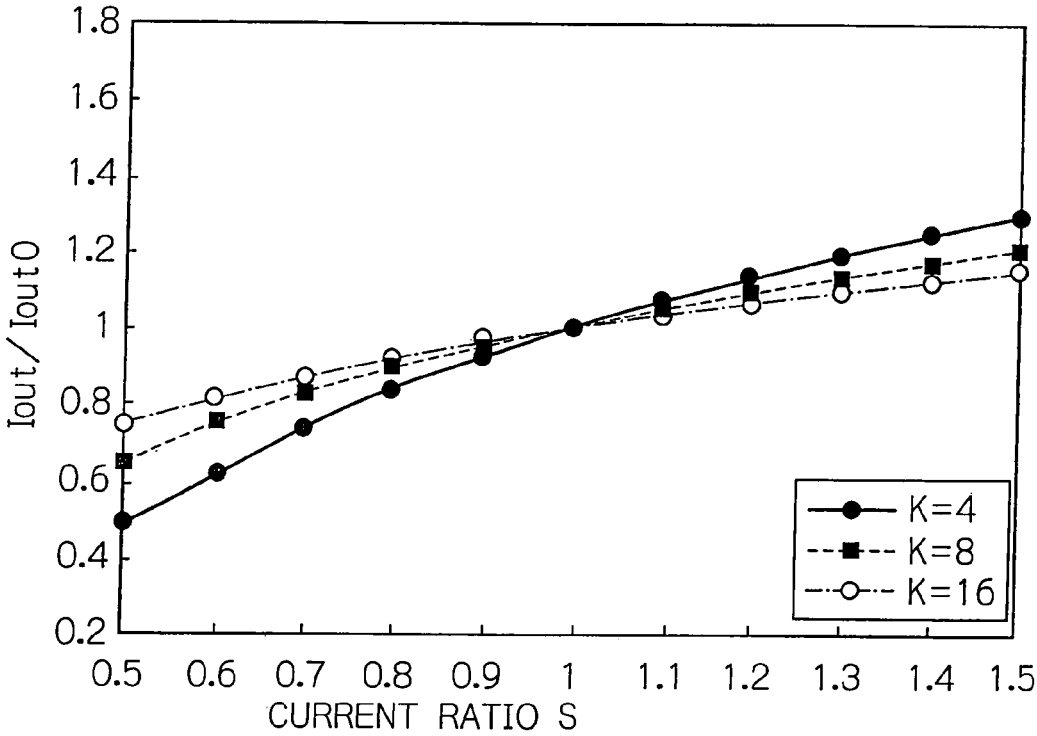
FIG. 3 is a graph plotting the characteristics of the PTAT current generator shown in FIG. 1.

The above leads to allowing the illustrative embodiment to adjust the current Iout with higher precision than a conventional method of adjusting the resistance value of the resistance element Re corresponding to the element 20 of the embodiment. In this instance, the current ratio S should be larger than 1/K. Furthermore, since the transistors which occupy smaller fabrication space in the generator 10 than the resistance elements are adapted for the adjustment, the increase in the circuit size can be minimized. The expression (2) may be exemplified graphically as shown in FIG. 3.

In the illustrative embodiment, the variable current source 16 described above is configured such that the transistors 200 through 204 serving as current sources with different sizes are arranged in parallel to each other, and the switches 210 are provided to the respective transistors 200 through 204 to control the currents passing through the transistors by turning the switches 210 on or off. The variable current source is, however, not restricted to this specific configuration. For example, a configuration may be adopted which is able to vary a current by controlling the gate voltage of transistors.

In the following, an alternative embodiment of the PTAT current generator will be described with reference to FIG. 4. A PTAT current generator 400 of this embodiment has a configuration similar to that of the embodiment shown in FIG. 1. In addition to that, the generator 400 is configured such that resistance elements 402 and 404, each having its resistance R0, are respectively connected between the node (Va) 28 and the resistance element Re and between the node (Vb) 32 and the diode (D2). In the illustrative embodiment, the constituent elements the same as in the embodiment shown in FIG. 1 will be labeled by the same reference numerals, and their repetitive description will be omitted. Furthermore, in regard to the transistor 16 of a variable current source, its internal constitution may be configured similar to the one shown in FIG. 2.

Now, the operation of the PTAT current generator 400 in the above configuration will be described. As in the case with the embodiment shown in FIG. 1, assume that the current I1 passes through the transistor (I1) 14, and the current S×I1 flows through the transistor (T2) 16.

As described before, the transistors 200 to 204 of the variable current source 16 are connected to the transistor (T1) 14 so as to form a current mirror. Furthermore, the current ratio S of the current source 16 to the transistor 14 is determined according to the length and width of the gate electrode of the transistors 16 and 14.

When the operational amplifier 30 is in operation, the nodes (Va) 28, (Vb) 32 and (Vc) 44 become almost at the same potential, deriving an expression (Re+R0)×I1+V1=R0×S×I1+V2. The voltages V1 and V2 can be determined by the general junction diode formula. The reference current Iout output from the output 46 can be defined by the following expression:

$$Iout=Vt\times LN(K\times S)/[Re+R0\times(1-S)] \quad (3)$$

provided that the transistors (T1) 14 and (T3) 18 are identical to each other, and the current Iout equals I1. Assume that the transistor 18 has its ratio of gate width to length W3/L3 equal to N×the ratio (W1/L1) of gate width to length of the transistor 14, then the output reference current Iout will be equal to N×I1.

As is clear from the expression (3), the current passing through the diode 26 is adjusted by the resistance elements (R0) 402 and 404 thus connected as well as the transistor or variable current source 16, thereby achieving the same effect that can be obtained by conventionally adjusting the resistance value of the resistance element Re corresponding to the resistor 20.

In the expression (3), assume that the resistance R0 is equal to m×Re, where the coefficient m is a predetermined positive number, and the output current when S=1 is represented by Iout0. The following expression can be formulated:

$$Iout/Iout0=(1+\mathrm{Log}_K S)/[1+m(1-S)] \quad (4)$$

Thus, the adjustment, relatively excellent in linearity, can be implemented to the current Iout with respect to the current ratio S.

Figure 5:
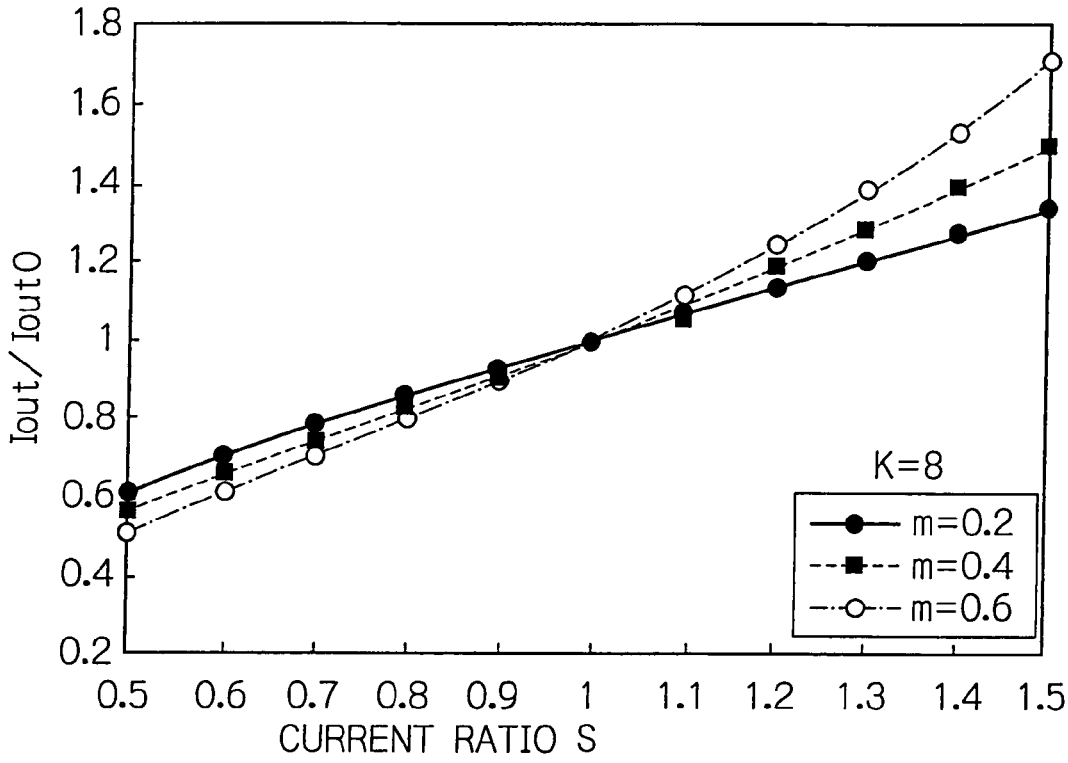
FIG. 5 is a graph plotting the characteristics of the PTAT current generator shown in FIG. 4.

Moreover, according to the usage of the PTAT current generator 400, the level of adjustment precision can be selected easily. In the alternative embodiment, however, the value of the current ratio S needs to be larger than 1/K and smaller than 1+1/m. In addition, used in the variable current source, i.e. transistor 16, are transistors which occupy smaller spaces compared to the resistance elements, and the additional resistance elements (R0) are only two, so that the increase in the circuit size can be minimized. The expression (4) is graphically shown in FIG. 5.

Figure 4:
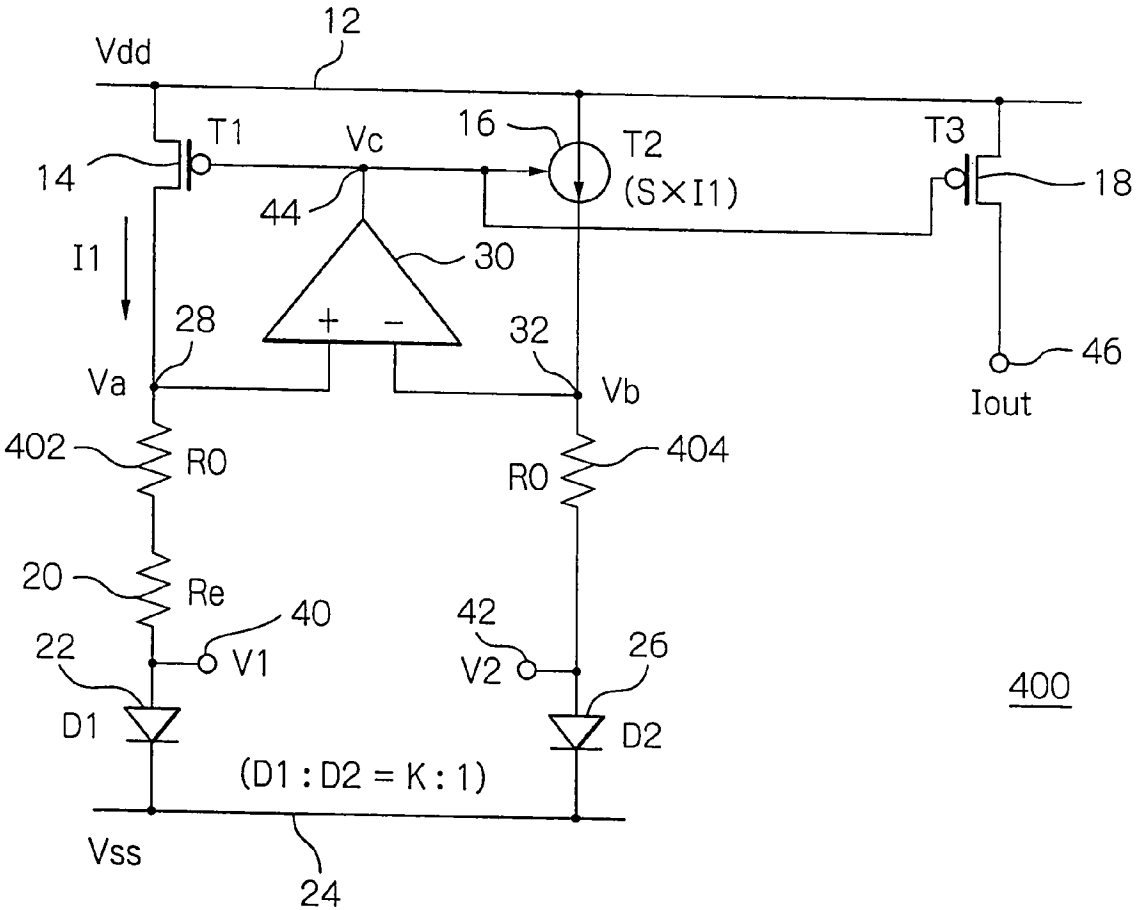
FIG. 4 is a schematic circuit diagram showing an alternative preferred embodiment of the PTAT current generator.

In the alternative embodiment shown in FIG. 4, the paths of the diode (D1) 22 and diode (D2) 26 include the respective resistance elements 402 and 404 connected, whose resistance value are the same as each other, i.e. equal to R0. Alternatively, resistance elements each having different resistance values may be used. These resistance elements can be replaced by transistors. Furthermore, the resistance values of the resistance elements (R0) 402 and 404 can be variable to change the adjustable range after manufactured.

Another alternative embodiment of the PTAT current generator will now be described with reference to FIG. 6. As shown in the figure, a PTAT current generator 600 of this alternative embodiment has, in addition to the configuration shown in FIG. 1, another operational amplifier 602 which has its noninverting input terminal (+) connected to the node 32, and its output 604 connected to its inverting input terminal (−) and also to the power supply line (Vss) 24 via an additional serial connection of resistance elements (R1) 606 and (R2) 608.

A node 610 between the resistance element (R1) 606 and resistance element (R2) 608 is connected to the power supply line (Vdd) 12 through the transistor 18 and also with a terminal 612 from which reference potential (Vref) is output. The transistors 14, 16 and 18 have the gates electrodes thereof further connected together to the gate electrode of an additional transistor (T4) 614 which is in turn connected to the power supply line (Vdd) 12 and the output terminal 46 on which the current Iout is output.

In accordance with the illustrative embodiment, it is possible to generate reference potential (Vref) that does not depend on temperature. By the application of an adjusting method similar to those of the above embodiments, the reference potential as well as the reference current output can be adjusted. Furthermore, the above-described PTAT current generators 10, 400 and 600 are the circuitry examples for generating PTAT current, and the adjustments illustrated on specific one of the embodiments are applicable to the other embodiments.

Figure 6:
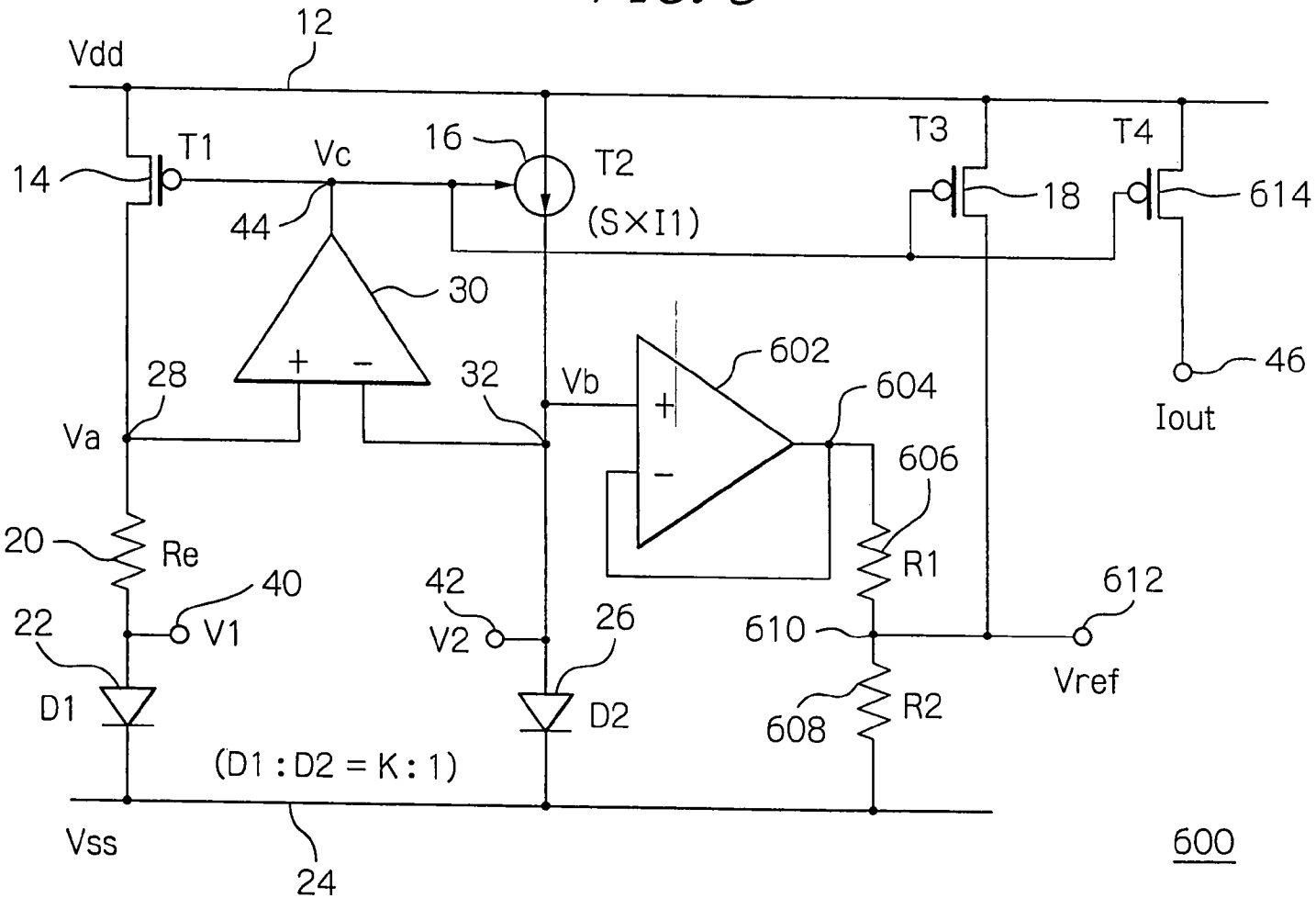
FIG. 6 shows in a schematic circuit diagram another alternative embodiment of the PTAT current generator.
Figure 7:
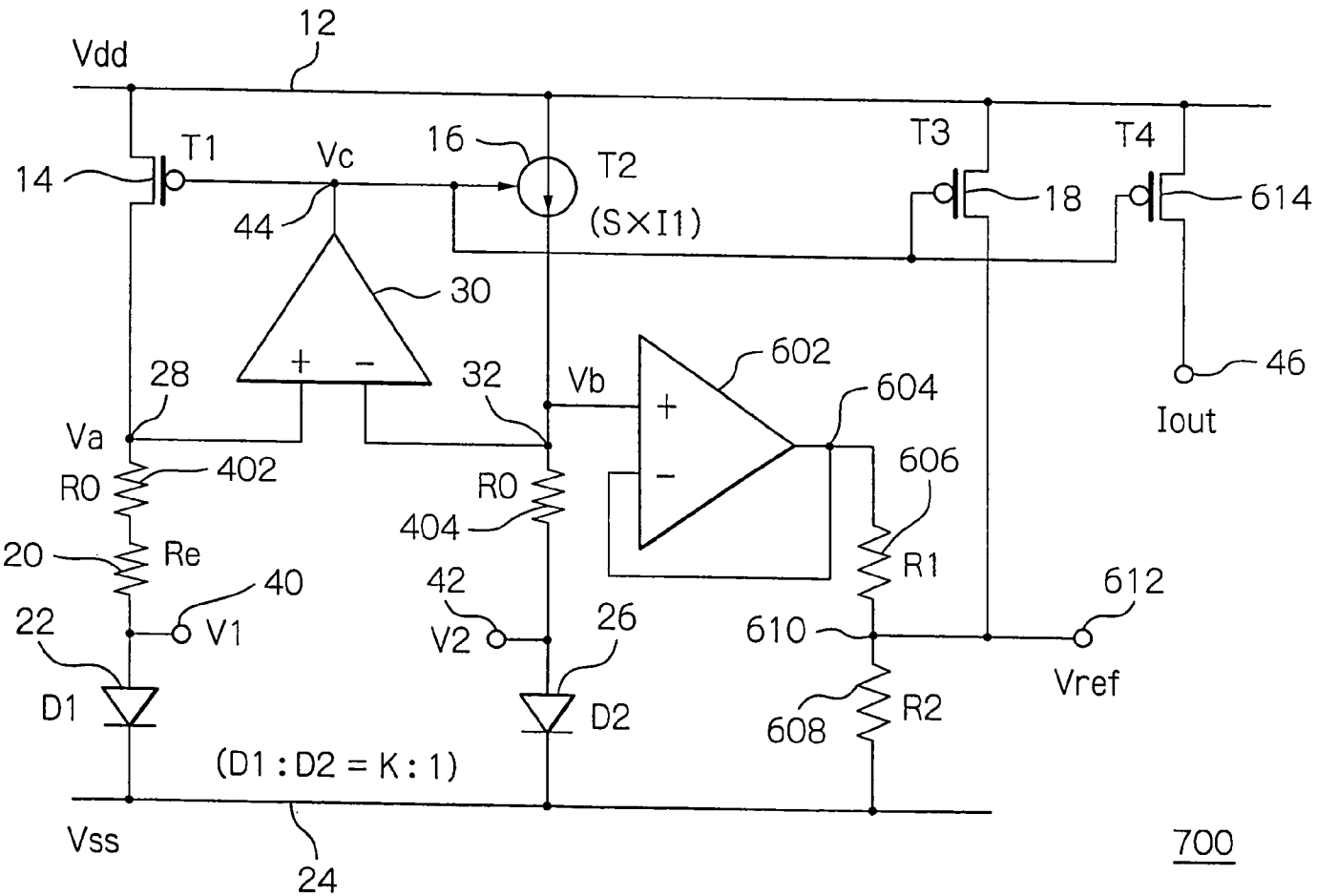
FIG. 7 shows in a schematic circuit diagram yet another alternative embodiment of the PTAT current generator.

Note that the additional configuration shown in FIG. 6 can be applied to the configuration shown in FIG. 4 to constitute a PTAT current generator. FIG. 7 shows a further alternative embodiment, or a PTAT current generator 700. In the instant alternative embodiment, the reference current output and reference potential can be adjusted as is the case with the above-described embodiments.

Figure 8:
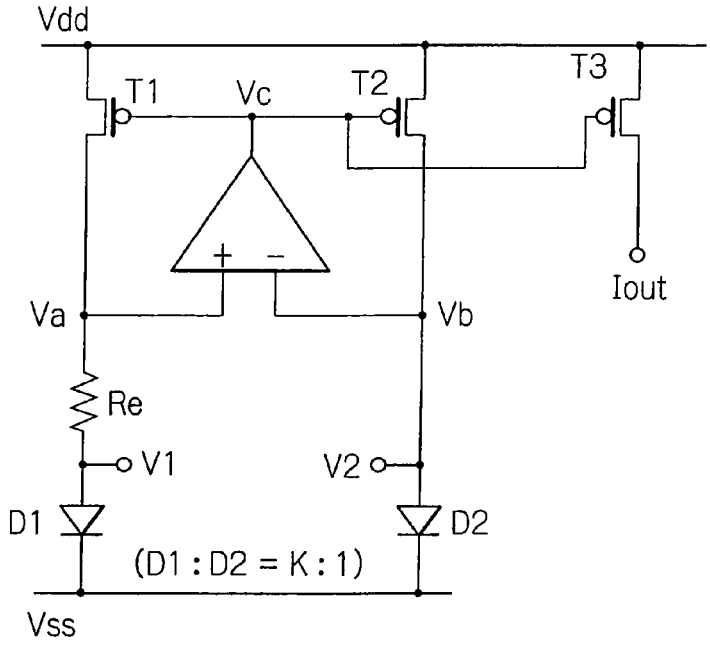
FIG. 8 PRIOR ART
FIG. 8 is a schematic circuit diagram showing a conventional reference current generator.
Figure 9:
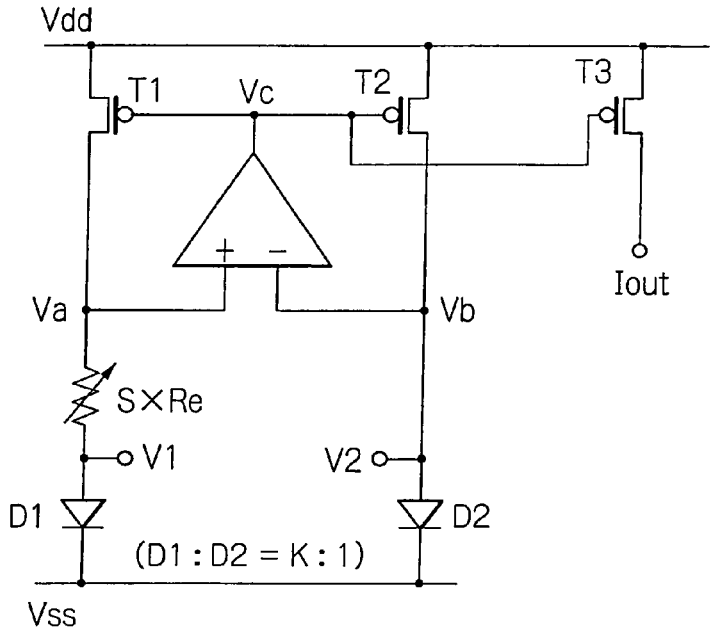
FIG. 9 PRIOR ART
FIG. 9 is a schematic circuit diagram showing another conventional reference current generator.

FIGS. 8 and 9 show configuration examples of conventional reference current generators. In the circuitry of FIG. 8, an output of PTAT current Iout is defined by the following expression:

$$Iout=Vt\times LN(K)/Re \quad (5)$$

$$Vt=k\times T/e \quad (6)$$

where k represents the Boltzmann constant, T is an absolute temperature and e is the electron charge.

Since a reference current is affected by the variability of device parameters arising from the manufacturing process of semiconductor integrated circuits, the conventional circuitry has adjustment means for adjustment after manufacture as shown in FIG. 9. More specifically, a variable resistance Re, whose value is variable, is connected to the anode of the diode D1 to thereby vary the resistance value Re to adjust a current Iout and reference potential. Assume that the output current Iout0 flows when the ratio S is equal to one, the following expression can be obtained:

$$Iout/Iout0=1/S \quad (7)$$

Figure 11:
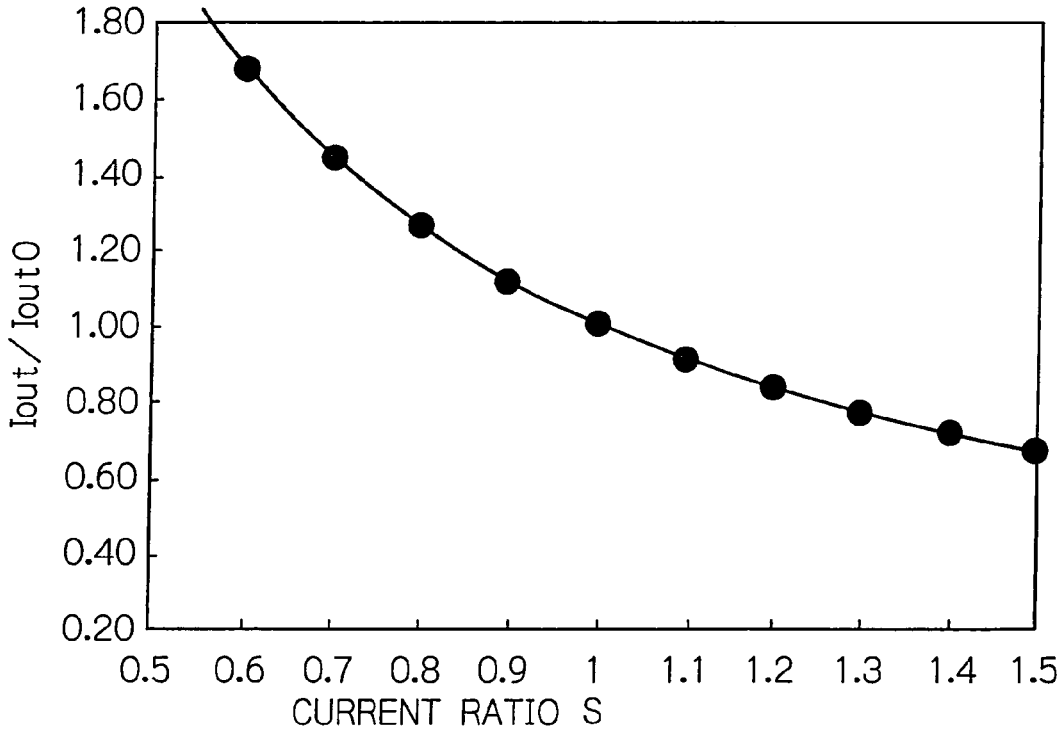
FIG. 11 PRIOR ART
FIG. 11 is a graph plotting the characteristic of the reference current generator shown in FIG. 9.

The current Iout, thus, increases or decreases in inverse proportion to the current ratio S as plotted in FIG. 11.

Figure 10:
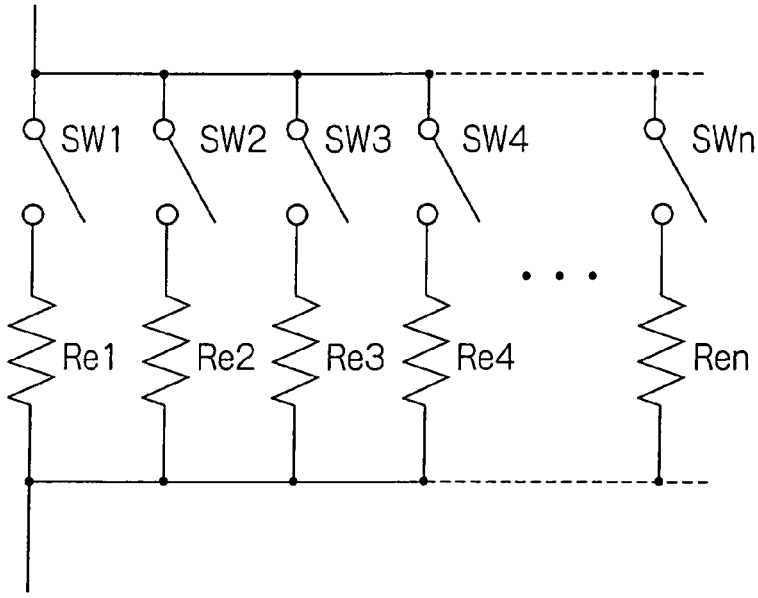
FIG. 10 PRIOR ART
FIG. 10 schematically shows the configuration of a variable resister in the reference current generator shown in FIG. 9.

Furthermore, in a conventional configuration example of the variable resistance Re, as shown in FIG. 10, resistance elements Re1 to Ren are selectively connected by turning switches SW1 to SWn on or off to thereby change the total resistance value of the variable resistance Re. Alternatively, the resistance elements Re1 to Ren are selectively connected by blowing fuses, instead of turning the switches conductive or not.

In such conventional configurations, however, the on-resistance of the switches, i.e. the resistance when the switches are turned on, or the resistance of the fuses are added to the resistance of the resistive elements, so that adjustment precision is lowered. To improve the precision, a multitude of resistance elements may be provided, of which resistance values are slightly different from each other. In this case, there is a drawback that an increase in size of a circuit cannot be avoided.

By contrast, the circuitry of the present invention includes a variable current source for supplying a variable current to thereby prevent increase in a circuit size and allow the gate voltage of a transistor of the variable current source to be varied.

The entire disclosure of Japanese patent application No. 2006-250777 filed on Sep. 15, 2006, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A reference current generator for generating a current substantially proportional to absolute temperature, comprising:

an operational amplifier for generating the current substantially proportional to absolute temperature;

an output circuit for outputting the current substantially proportional to absolute temperature delivered from said operational amplifier;

a first resistance element connected to a first input of said operational amplifier;

a second resistance element connected in series to said first resistance element;

a third resistance element connected to a second input of said operational amplifier; and a variable current source connected to an output of said operational amplifier for producing a variable current to vary the current substantially proportional to absolute temperature, said variable current source comprising a plurality of transistors; and a plurality of switches for selecting said plurality of transistors, said plurality of switches being selected to thereby generate the variable current, said third resistance element being connected to said variable current source to utilize a voltage drop across the third resistance element to cause said output circuit to output the current substantially proportional to absolute temperature, said second resistor and third resistor having the same resistance values as each other.

2. The generator in accordance with claim 1, wherein said generator is fabricated in a form of integrated circuit.

3. A reference current generator for generating a current substantially proportional to absolute temperature, comprising:

a first transistor of a current source for generating a fixed current;

a first resistance element connected in series to said first transistor;

a variable current source controlled for producing a variable current;

a second resistance element connected to said first resistance element, thereby performing a first current path a first diode connected to said second resistance element;

a third resistance element connected to said variable current source, thereby performing a second current path;

a second diode connected to said third resistance element;

an operational amplifier having a first input terminal connected to a first node between said first transistor and said first resistance element, and a second input terminal connected to a second node between said variable current source and said third resistance element, thereby performing operational amplification of voltage at the first and second nodes; and a second transistor connected to an operational output of said operational amplifier to output a current depending on the operational output, said variable current source comprising a plurality of transistor elements, and a plurality of switches connected for selecting at least any of said plurality of transistor elements, the operational output of said operational amplifier being further connected to a gate electrode of each of said first and second transistors and said variable current source, said variable current source inputting the operational output to gate electrodes of said plurality of transistor elements to supply the second input terminal and said second diode with a current output from at least any of said transistor elements selected by said plurality of switches as the variable current output form said variable current source.

* * * * *